US007884698B2

(12) United States Patent
Tanaka et al.

(10) Patent No.: US 7,884,698 B2
(45) Date of Patent: Feb. 8, 2011

(54) ELECTRONIC COMPONENT, AND METHOD FOR MANUFACTURING THE SAME

(75) Inventors: Hideki Tanaka, Higashiosaka (JP); Tomoyuki Washizaki, Fukui (JP); Kiyoshi Ikeuchi, Nishinomiya (JP); Toshiyuki Iwao, Fukui (JP); Yasuki Nagatomo, Sadowara-cho (JP); Kesato Iiboshi, Takanabe-cho (JP); Jiro Ota, Sadowara-cho (JP); Yasuhiro Izumi, Shintomi-cho (JP)

(73) Assignee: Panasonic Corporation, Osaka (JP)

( * ) Notice: Subject to any disclaimer, the term of this patent is extended or adjusted under 35 U.S.C. 154(b) by 533 days.

(21) Appl. No.: 10/554,699

(22) PCT Filed: Apr. 30, 2004

(86) PCT No.: PCT/JP2004/006276

§ 371 (c)(1),
(2), (4) Date: Oct. 27, 2005

(87) PCT Pub. No.: WO2004/100187

PCT Pub. Date: Nov. 18, 2004

(65) Prior Publication Data

US 2006/0255897 A1 Nov. 16, 2006

(30) Foreign Application Priority Data

May 8, 2003 (JP) ..... 2003-130091

(51) Int. Cl.
*H01H 85/04* (2006.01)
*H01H 85/12* (2006.01)
*H01H 69/02* (2006.01)

(52) U.S. Cl. ..... 337/297; 337/290; 337/160; 337/296; 29/623

(58) Field of Classification Search ..... 337/159, 337/257, 160, 290, 296, 297; 29/623
See application file for complete search history.

(56) References Cited

U.S. PATENT DOCUMENTS 2,576,405 A * 11/1951 McAlister ..... 337/232

(Continued)

FOREIGN PATENT DOCUMENTS

JP 04062737 A * 2/1992

(Continued)

OTHER PUBLICATIONS

Supplementary European Search Report issued Oct. 14, 2009 in European Application No. 04730643.6.

*Primary Examiner*—Jayprakash N Gandhi
*Assistant Examiner*—Bradley H Thomas
(74) *Attorney, Agent, or Firm*—Wenderoth, Lind & Ponack, L.L.P.

(57) ABSTRACT

An electronic component is provided in which: impact-absorbing layers are provided so as to cover at least the corner portions of both end portions of a base which is made of an insulating mixture of ceramic and glass; a conductive film is formed so as to cover the surface of these impact-absorbing layers and the surface of the base; the portions of this conductive film which cover the surfaces of the impact-absorbing layers are formed into electrodes; and a resistance-adjusting groove is provided in an other portion of the conductive film than the portions serving as the electrodes.

19 Claims, 4 Drawing Sheets

U.S. PATENT DOCUMENTS 3,391,371 A * 7/1968 Wright et al. ..... 337/417
4,159,458 A * 6/1979 Wiebe ..... 337/252
4,458,294 A 7/1984 Womack
5,166,656 A * 11/1992 Badihi et al. ..... 337/297
5,228,188 A * 7/1993 Badihi et al. ..... 29/623
5,296,833 A * 3/1994 Breen et al. ..... 337/297
5,432,378 A * 7/1995 Whitney et al. ..... 257/529
5,440,802 A * 8/1995 Whitney et al. ..... 29/623
5,441,783 A * 8/1995 Silgailis et al. ..... 428/37
5,621,375 A * 4/1997 Gurevich ..... 337/297
5,642,090 A * 6/1997 Arikawa ..... 337/297
5,680,092 A * 10/1997 Yamada et al. ..... 338/309
5,726,620 A * 3/1998 Arikawa ..... 337/227
5,726,621 A * 3/1998 Whitney et al. ..... 337/297
5,774,037 A * 6/1998 Gurevich ..... 337/248
5,841,624 A * 11/1998 Xu et al. ..... 361/234
5,907,274 A * 5/1999 Kimura et al. ..... 338/309
5,917,403 A * 6/1999 Hashimoto et al. ..... 338/307
5,929,741 A * 7/1999 Nishimura et al. ..... 337/290
5,986,875 A * 11/1999 Donde et al. ..... 361/234
6,013,358 A * 1/2000 Winnett et al. ..... 428/210
6,034,589 A * 3/2000 Montgomery et al. ..... 337/296
6,078,245 A * 6/2000 Fritz et al. ..... 337/297
6,087,920 A * 7/2000 Abramov ..... 336/192
6,087,921 A * 7/2000 Morrison ..... 336/200
6,094,123 A * 7/2000 Roy ..... 336/200
6,388,550 B1 * 5/2002 Kanetaka et al. ..... 336/223
6,492,885 B1 * 12/2002 Murata et al. ..... 333/185
6,771,476 B2 * 8/2004 Fukuoka et al. ..... 361/103
6,864,774 B2 * 3/2005 Kanetaka et al. ..... 336/83
6,867,133 B2 * 3/2005 Kanetaka et al. ..... 438/678
6,912,760 B2 * 7/2005 Uchiyama et al. ..... 29/25.35
2001/0000215 A1 * 4/2001 Oh ..... 338/306
2002/0097547 A1 * 7/2002 Fukuoka et al. ..... 361/118
2003/0079904 A1 5/2003 Sato et al.
2004/0025322 A1 * 2/2004 Binnard ..... 29/592.1
2004/0034993 A1 * 2/2004 Rybka et al. ..... 29/623
2004/0169578 A1 * 9/2004 Jollenbeck et al. ..... 337/227
2005/0085008 A1 * 4/2005 Derderian et al. ..... 438/106

FOREIGN PATENT DOCUMENTS

JP 4-99502 8/1992
JP 5-06559 2/1993
JP 05205903 A * 8/1993
JP 06053003 A * 2/1994
JP 06053005 A * 2/1994
JP 06295801 A * 10/1994
JP 7-307201 11/1995
JP 09129115 A * 5/1997
JP 10-335103 12/1998
JP 2002-246211 8/2002
JP 2003-115403 4/2003

* cited by examiner

ELECTRONIC COMPONENT, AND METHOD FOR MANUFACTURING THE SAME

TECHNICAL FIELD

The present invention relates to an electronic component which is used for various kinds of electronic equipment, and a manufacturing method for the same.

BACKGROUND ART

A conventional electronic component of this type will be described with reference to FIGS. 4A and 4B. FIG. 4A is a perspective view of a circuit protective element which is an example of the conventional electronic component. FIG. 4B is a sectional view of the circuit protective element, seen along an A-A line in FIG. 4A.

As shown in FIGS. 4A and 4B, the circuit protective element is configured by: a base 1; a conductive film 2; a protective film 5; and a plating layer 7. The base 1 is shaped like a pillar, such as a column and a prism. It is made of any of ceramic, glass, and a mixture of ceramic and glass, which have an insulation characteristic. The conductive film 2 is made of copper, silver, nickel or the like. It is formed over the entire surface of the base 1. An electrode 6 is formed by each of the portions of the conductive film 2 which are located at both end portions of the base 1. A plating layer 7 is formed on the surface of the electrode 6. The protective film 5 is made of epoxy resin or the like. It is formed so as to cover the portion of the conductive film 2's surface except its portions located at both end portions of the base 1.

A portion of the conductive film 2 is cut off by means of laser irradiation or the like. Thereby, a resistance-adjusting groove 3 is created in the conductive film 2. It makes substantially one turn so that its tips overlap each other. The region between the portions in which the tip portions of the resistance-adjusting groove 3 overlap each other is a narrow portion 4. As an electronic component which has such a groove, for example, there is a chip component which is disclosed in Japanese Patent Laid-Open No. 7-307201 specification.

Herein, the conductive film 2 is a portion which fulfills the electrical function of the circuit protective element. For example, if an electronic component is a resistor, it becomes a resistant body. In the case of the circuit protective element shown in FIGS. 4A and 4B, it turns into a fusing portion with a fusing function. In this case, if an over-current beyond a certain level is applied, the narrow portion 4 provided in the conductive film 2 generates heat. Thereby, it is melted and fused. This breaks the current which is applied on the circuit protective element.

Next, a manufacturing method will be described for the above described circuit protective element. First, over the whole surface of the base 1, the conductive film 2 is formed by means of plating. In this case, the electrode 6 is formed by the conductive film 2 located at both end portions of the base 1.

Sequentially, the conductive film 2 is irradiated with a laser beam to cut off a portion of the conductive film 2. Thereby, the resistance-adjusting groove 3 is formed which has substantially one turn so that its tips overlap each other. At this time, the narrow portion 4 is formed within the region between the overlapped portions in the tip portions of the resistance-adjusting groove 3.

Next, the protective film 5 made of epoxy resin or the like is formed to cover the surface of the conductive film 2 other than the portions located at both end portions of the base 1. Finally, the plating layer 7 is formed on the surface of the electrode 6.

In the circuit protective element which is manufactured in this way, a resistance value is measured in its manufacturing process, or the resistance-adjusting groove 3 is formed. In order to take such a measurement, the circuit protective element needs to be held. A chuck is pressed against the electrode 6 so as to come into contact with it. Thereby, the circuit protective element can be held.

At this time, if the contact resistance between the chuck and the electrode 6 becomes greater, the contact resistance at this portion may adversely affect the measurement of a resistance value. This makes it impossible to adjust the resistance value precisely. Therefore, the contact resistance between the chuck and the electrode 6 has to be made as low as possible. In order to reduce the contact resistance between the chuck and the electrode 6, the chuck needs to be pressed on the electrode 6 by a strong force.

On the other hand, in the above described circuit protective element, the conductive film 2 is formed on the entire surface of the base 1. Thereby, the conductive film 2 is united with the electrode 6 which is located at both end portions of the base 1. In this case, the conductive film 2 and the electrode 6 are continuously formed, thus helping stabilize their electrical and mechanical connection.

However, if the conductive film 2 and the electrode 6 are continuously united, then depending upon the circuit protective element's resistance value, the conductive film 2 becomes thinner and the electrode 6 also thins down. At this time, in order to lower the contact resistance between the chuck and the electrode 6, the chuck is pressed against the electrode 6 by a strong force. Then, the base 1 cannot absorb all the mechanical impact at the time when it is pressed, and thus, the corner portions at both end portions of the base 1 may be chipped. This is because the base 1 is made of any of ceramic, glass, and a mixture of ceramic and glass. If the circuit protective element which has such a chip in its corner portions is mounted on a printed board or the like, its stable electrical connection cannot be obtained. Hence, the circuit protective element with any chips in the corner portions has to be removed, thus deteriorating its yield when manufactured.

DISCLOSURE OF THE INVENTION

It is an object of the present invention to provide an electronic component and its manufacturing method in which even if a chuck is pressed against an electrode located on both end-portion sides of a base by a strong force for the purpose of holding the electronic component, then the corner portions at both end portions of the base can be prevented from being chipped, and thus, its yield rate can be improved.

An electronic component according to an aspect of the present invention electronic component includes: an insulating base; an impact-absorbing layer which is formed so as to cover at least the corner portions of both end portions of the base; and a conductive film which is formed so as to cover at least a portion of the surface of the base and the surface of the impact-absorbing layer.

In the above described electronic component, even if a mechanical impact is given to both end portions of the base when the electronic component is held, this mechanical impact can be absorbed into the impact-absorbing layer. Therefore, in order to hold the electronic component, even if a chuck is pressed, by a strong force, on an electrode located on both end-portion sides of the base, then the corner portions at both end portions of the base can be hindered from being chipped. This helps enhance its yield.

An electronic-component manufacturing method according to another aspect of the present invention includes: a first process of forming an impact-absorbing layer so as to cover at least the corner portions of both end portions of an insulating base; and a second process of forming a conductive film so as to cover at least a portion of the surface of the base and the surface of the impact-absorbing layer.

In the above described electronic-component manufacturing method, an impact-absorbing layer is formed so as to cover at least the corner portions of both end portions of an insulating base. Thereafter, a conductive film is formed so as to cover at least a portion of the surface of the base and the surface of the impact-absorbing layer. Therefore, the impact-absorbing layer can be formed between both end portions of the base and the conductive film. As a result, even if a mechanical impact is given to both end portions of the base when the electronic component is held, this mechanical impact can be absorbed into the impact-absorbing layer. Therefore, in order to hold the electronic component, even if a chuck is pressed, by a strong force, on an electrode located on both end-portion sides of the base, then the corner portions at both end portions of the base can be hindered from being chipped. This helps enhance its yield. Besides, the impact-absorbing layer is formed before the conductive film is formed. Therefore, when the impact-absorbing layer is formed, the conductive film which is an element assembly of the electronic component can be kept from being damaged. This prevents the characteristics of an electric component from being deteriorated.

BEST MODE FOR IMPLEMENTING THE INVENTION

Figure 1A:
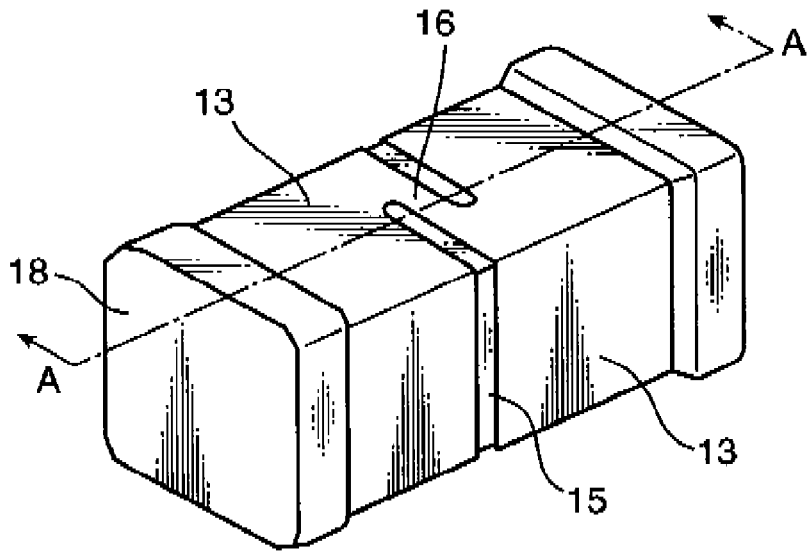
FIG. 1A is a perspective view of a circuit protective element according to an embodiment of the present invention.
Figure 1B:
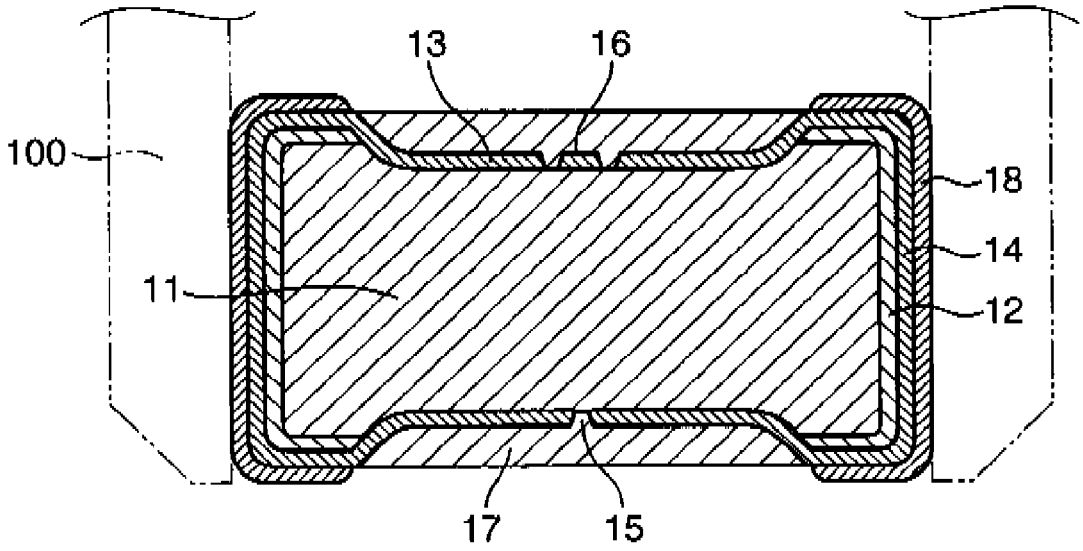
FIG. 1B is a sectional view of the circuit protective element, seen along an A-A line in FIG. 1A.

Hereinafter, a circuit protective element according to an embodiment of the present invention will be described with reference to the drawings. FIG. 1A is a perspective view of the circuit protective element according to the embodiment of the present invention. FIG. 1B is a sectional view of the circuit protective element, seen along an A-A line in FIG. 1A. Herein, a circuit protective element will be described below as an example of the electronic component. However, the electronic component to which the present invention is applied is not limited especially to this example. Hence, it can be similarly applied to various chip components or the like.

The circuit protective element shown in FIGS. 1A and 1B is configured by: a base 11; an impact-absorbing layer 12; a conductive film 13; a protective film 17; and a plating layer 18. The base 11 is made of an insulating mixture of ceramic and glass. It is shaped like a prism, and its section at both ends is thicker than that in the center as if it were an iron dumbbell.

The impact-absorbing layer 12 is made of copper which is a ductile metallic material. It is formed by means of electroless plating with copper, on the entire surface of both end portions of the base 11, or on both end surfaces of the base 11 and on side surfaces which extend out from both end surfaces. Herein, ductility means an object's property of the object itself stretching without being destroyed.

In order to configure the conductive film 13, a metallic film is formed by a sputtering method using titanium and copper. Then, it is plated with nickel, copper and gold in order. This multi-layer film covers the base 11 and the whole surface of the impact-absorbing layer 12. In the conductive film 13, the portion which covers the surface of the impact-absorbing layer 12 is used as an electrode 14.

The portion of the conductive film 13 other than the portions located on both end-portion sides of the base 11, for example, a portion of its middle portion, is helically cut off using a trimming method such as laser irradiation. Thereby, a resistance-adjusting groove 15 is formed which has substantially one turn so that its tips overlap each other at a predetermined interval. At this time, a narrow portion 16 is formed in the region between the portions in which the tip portions of the resistance-adjusting groove 15 overlap each other. In the narrow portion 16, a fusing portion is formed which functions as a fuse. Thereby, if an over-current beyond a certain level is applied on the circuit protective element, the narrow portion 16 provided in the conductive film 13 generates heat. Then, it is melted and fused, thus breaking the current which is given to the circuit protective element.

The protective film 17 is made of epoxy resin or the like. It is formed to cover the entire surface of the middle portion of the conductive film 13. Thereby, it protects the portion except the conductive film 13 located on both end-portion sides of the base 11. The plating layer 18 is made of a nickel plating layer and a tin plating layer. It is formed so as to cover the portion of the conductive film 13 which covers the surface of the impact-absorbing layer 12, or the surface of the electrode 14. Herein, in FIG. 1A, the protective film 17 is omitted so that the resistance-adjusting groove 15 and the narrow portion 16 can be clearly shown.

As described above, in this embodiment, the impact-absorbing layer 12 is provided so as to cover at least the corner portions of both end portions of the base 11 which is made of a brittle material which is an insulating mixture of ceramic and glass. Then, the conductive film 13 is formed so as to cover the impact-absorbing layer 12 and the surface of the base 11. In the conductive film 13, the portion which covers the surface of the impact-absorbing layer 12 is used as the electrode 14.

Therefore, when a resistance value is measured, or when the resistance-adjusting groove 15 is formed, in order to hold the circuit protective element, even if a chuck 100 is pressed, by a strong force, against the electrode 14 located on both end-portion sides of the base 11, then the impact-absorbing layer 12 provided between both end portions of the base 11 and the electrode 14 can absorb a mechanical impact at the time when it is pressed. Thereby, the corner portions of both end portions of the base 11 can be hindered from being chipped, thus improving its yield rate.

In addition, copper which is a ductile metallic material is used as the impact-absorbing layer 12. Therefore, the above described mechanical impact can be certainly absorbed. Besides, the protective film 17 is provided on the surface of the conductive film 13 so that it covers at least the resistance-adjusting groove 15. Thereby, the resistance-adjusting groove 15 can also be certainly protected.

Furthermore, the plating layer 18 made of a nickel plating layer and a tin plating layer is formed on the surface of the conductive film 13 located on both end-portion sides of the base 11. Therefore, the surface mounting of the circuit protective element can be conducted, thus making smaller and thinner a circuit or the like which the circuit protective element is mounted.

Herein, the three-dimensional shape of the base 11 is not limited especially to the above described example. Another shape but a prism, for example, a columnar shape, a sheet-like shape or the like may also be used. Moreover, without changing its section's thickness at both ends from that in the center, the base 11 whose section has the same thickness from one of its ends up to the other may also be used. In addition, the sectional shape of the base 11 is not limited especially to the above described example. Various shapes can also be used, such as a regular polygon, a circle, a rectangle and an ellipse. Furthermore, the material of the base 11 is not limited especially to the above described example, either. A single insulating material such as ceramic and glass may also be used. The present invention can be suitably used for various insulating brittle materials.

Herein, the method of forming the impact-absorbing layer 12 is not limited especially to the above described example, either. Various formation methods, such as another plating method, a sputtering method and a printing method, can also be used. Furthermore, the material of the impact-absorbing layer 12 is not limited especially to the above described example, either. A ductile metallic material, such as gold, silver, platinum, nickel, chromium, palladium and an alloy of these, can also be used. Moreover, the portion of the base 11 in which the impact-absorbing layer 12 is formed is not limited especially to the above described example, either. The impact-absorbing layer 12 can be provided in another portion, as long as it coves at least the corner portions of both end portions of the base 11 which is easily chipped by a mechanical impact, or the portions (i.e., the edge portions of both end portions) where the end surfaces of the base 11 intersect the side surfaces which extend from the end surfaces.

The portion in which the conductive film 13 is formed is not limited especially to the above described example, either. There is no need to cover the portion except the electrode 14 located on both end-portion sides of the base 11, or the whole surface of the middle portion of the base 11. It may also be formed so as to cover only a portion of the surface of the middle portion of the base 11, or the portion where a current concentrated portion is formed which becomes a fusing portion that embodies a fusing function. In that case, it is continuously united with the electrode 14 located on both end-portion sides of the base 11. In addition, the material and formation method of the conductive film 13 are not limited especially to the above described example, either. Various conductive films can be used: only a metallic film is used which is formed by a sputtering method using titanium and copper; a multi-layer film is used which is formed by plating this metallic film with one or two that are chosen from among nickel, copper, gold, silver and the like; or a metallic film is used which is formed by plating this metallic film with one or more that are chosen from among nickel, copper, gold, silver and the like. A choice among these conductive films can be arbitrarily made according to what an electric component is used for. The usage purpose includes, for example: determining a resistance-value range; inhibiting the surface of the conductive film 13 from oxidizing; prompting the narrow portion 16 made of the conductive film 13 to be melted and fused; storing the heat which is generated at the narrow portion 16; and the like.

The shape of the resistance-adjusting groove 15 is not limited especially to the above described example, either. Various shapes can also be used, for example, a resistance-adjusting groove which is a little short of substantially one turn is formed in the conductive film 13, so that the tips of the groove face each other at an interval and do not overlap each other. Then, the region between the tip portions of the resistance-adjusting groove may also be used as a narrow portion which makes up a fusing portion. Furthermore, a resistance-adjusting groove can be formed in the conductive film 13, so that it makes several turns around the base 11. Thereby, it can also be as an electronic component such as an inductor and a resistor. Moreover, the method of forming the resistance-adjusting groove 15 is not limited especially to the above described example, either. A narrow portion which makes up a fusing portion may also be formed by forming a notch in the conductive film 13 by a mechanical cutting method using a trimming blade or the like.

In addition, the material of the protective film 17 is not limited especially to the above described example, either. Another resin may also be used, such as a phenol resin, a polyimide resin and a silicone resin. Besides, a denatured resin of each of these, also including an epoxy resin, may also be used. Furthermore, the position in which the protective film 17 is formed is not limited especially to the above described example, either. It does not necessarily cover the entire surface of the middle portion of the conductive film 13, as long as it covers at least the position where the resistance-adjusting groove 15 is formed.

Next, the manufacturing method for the circuit protective element shown in FIGS. 1A and 1B will be described in further detail. FIGS. 2A to 2F and FIGS. 3A to 3F illustrate a manufacturing process for explaining the manufacturing method of the circuit protective element shown in FIGS. 1A and 1B. Herein, FIGS. 2A, 2C, 2E and FIGS. 3A, 3C, 3E are perspective views of the circuit protective element shown in FIGS. 1A and 1B in each manufacturing process. FIGS. 2B, 2D, 2F and FIGS. 3B, 3D, 3F are sectional views of the circuit protective element, seen along the A-A line in FIGS. 2A, 2C, 2E and FIGS. 3A, 3C, 3E.

Figure 2A:
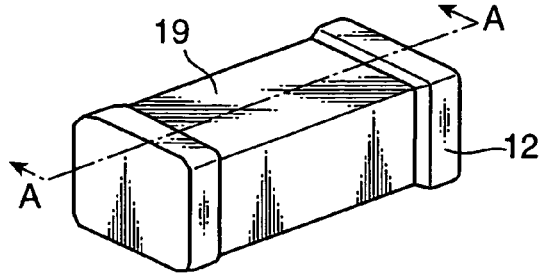
FIGS. 2A to 2F are perspective and sectional views of the circuit protective element shown in FIGS. 1A and 1B, showing its manufacturing method and processes.
Figure 2B:
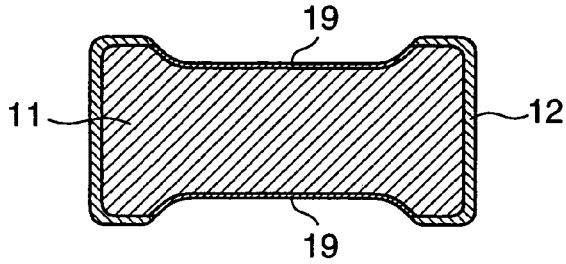

First, with reference to FIGS. 2A and 2B, a resist film 19 is formed on the whole surface except both end portions of the base 11 which is made of an insulating mixture of ceramic and glass. Next, the impact-absorbing layer 12 made of copper is formed by electro-less plating, so that it covers the whole surface of both end portions of the base 11 other than the resist film 19. Herein, in the case where the impact-absorbing layer 12 or the conductive film 13 is formed by electro-less plating, preferably, in advance, the entire surface of the base 11 should be etched and undergo an activation treatment which has a catalytic action for electro-less plating.

Figure 2C:
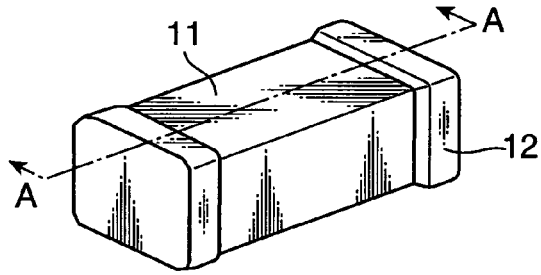
Figure 2D:
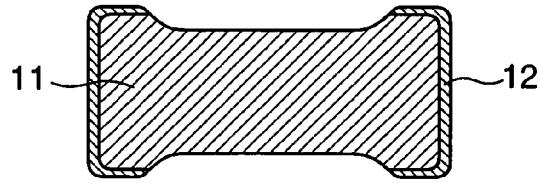

Sequentially, as shown in FIGS. 2C and 2D, the resist film 19 is removed from the base 11. At this time, the resist film 19 and the portion of the impact-absorbing layer 12 which adheres to the resist film 19 are simultaneously removed. As a result, the impact-absorbing layer 12 remains only in both end portions of the base 11. Hence, in its portion other than this, the surface of the base 11 is exposed.

Figure 2E:
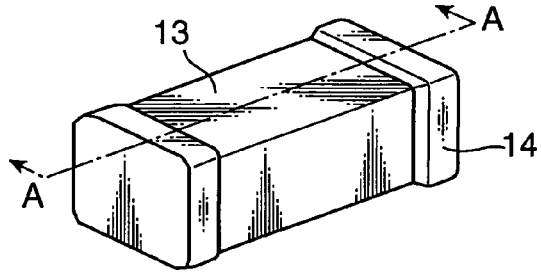
Figure 2F:
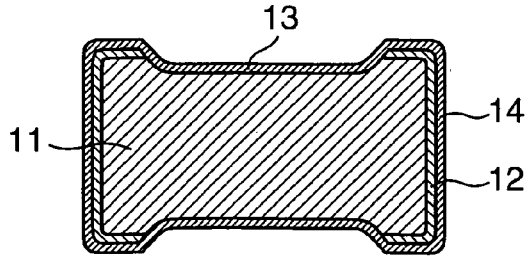

Next, as shown in FIGS. 2E and 2F, the conductive film 13 is formed so as to cover the entire surface of the portion of the base 11 which is exposed by removing the resist film 19 and the portion of the impact-absorbing layer 12 that adheres to the resist film 19 at the same time, as well as the whole surface of the impact-absorbing layer 12. As the conductive film 13, a metallic film is formed by a sputtering method using titanium and copper. Then, it is plated with nickel, copper and gold in order. At this time, in the conductive film 13, the portion which covers the surface of the impact-absorbing layer 12 is used as the electrode 14. Thereby, the conductive film 13 is united with the electrode 14 which is located at both end portions of the base 11. This makes the conductive film 13 and the electrode 14 continuous. In this case, the conductive film 13 and the electrode 14 are continuously formed, thus helping stabilize the electrical and mechanical connection of the conductive film 13 to the electrode 14.

Figure 3A:
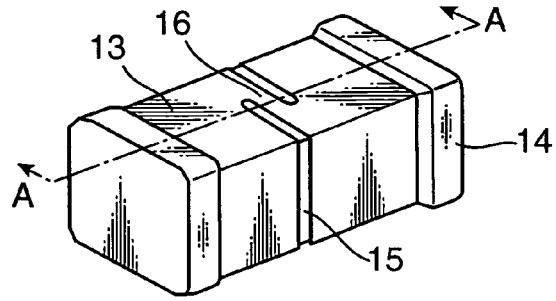
FIGS. 3A to 3F are perspective and sectional views of the circuit protective element shown in FIGS. 1A and 1B, showing its manufacturing method and processes.
Figure 3B:
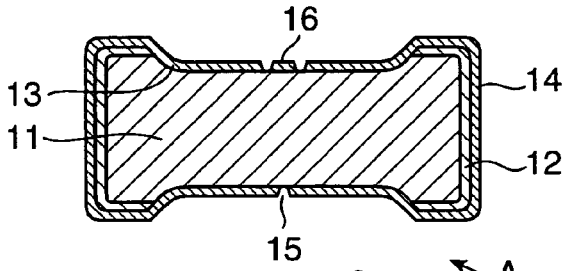

Sequentially, as shown in FIGS. 3A and 3B, a portion of the conductive film 13 is cut off by means of laser irradiation. Thereby, the resistance-adjusting groove 15 is formed which makes substantially one turn so that its tips overlap each other. At this time, a narrow portion 16 is formed in the region between the portions in which the tip portions of the resistance-adjusting groove 15 overlap each other.

Figure 3C:
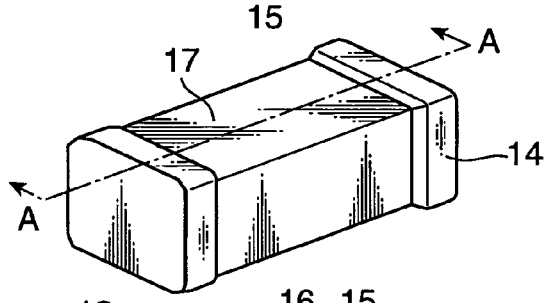
Figure 3D:
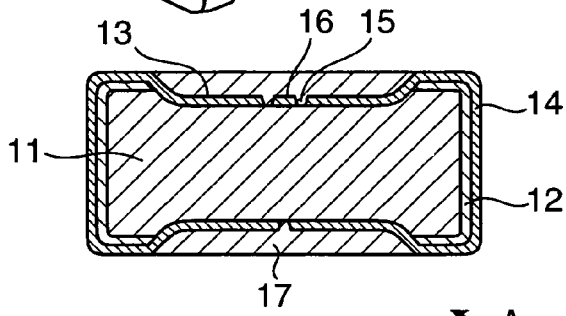
Figure 3E:
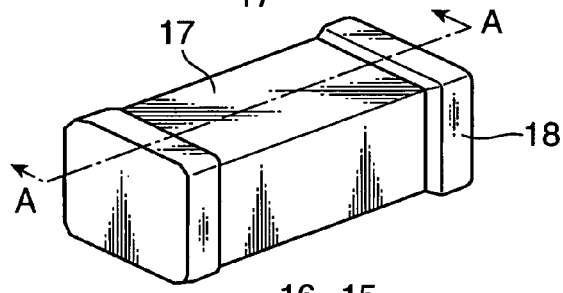
Figure 3F:
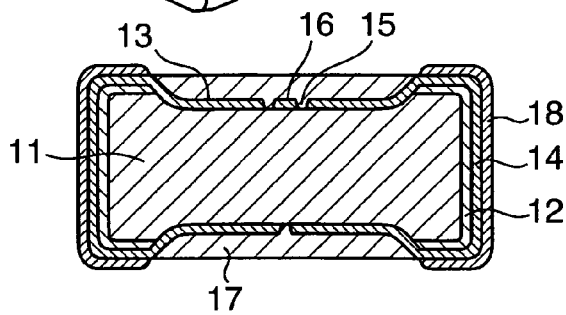
Figure 4A:
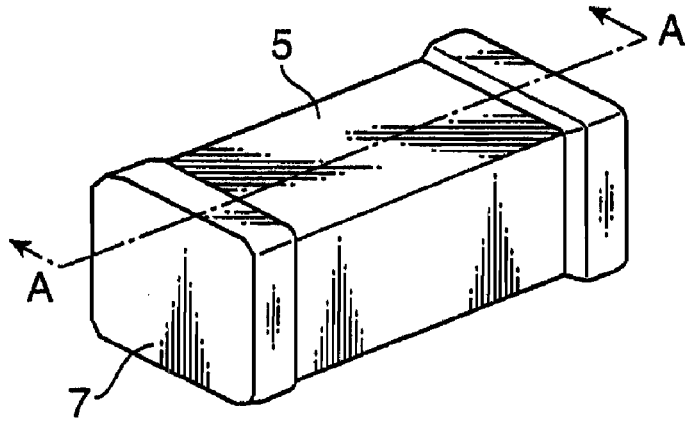
FIG. 4A PRIOR ART
FIG. 4A is a perspective view of a circuit protective element which is an example of a conventional electronic component.
Figure 4B:
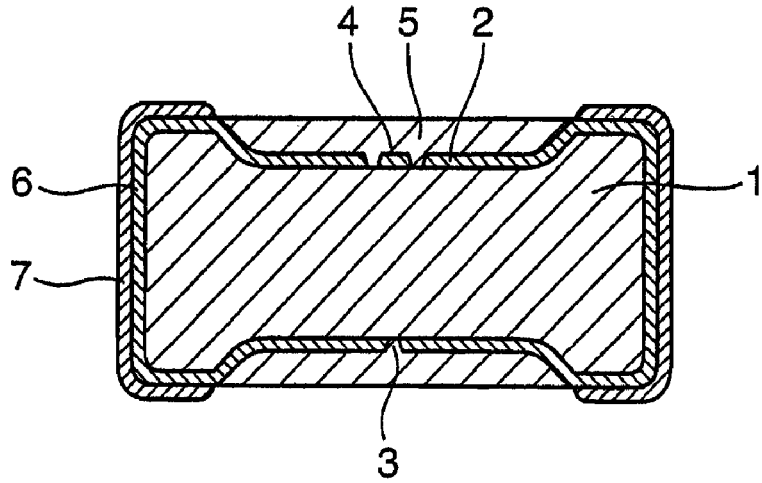
FIG. 4B PRIOR ART
FIG. 4B is a sectional view of the circuit protective element, seen along an A-A line in FIG. 4A.

Next, as shown in FIGS. 3C and 3D, the protective film 17 which is made of epoxy resin or the like is formed so as to cover the portion of the conductive film 13's surface except its portions located at both end portions of the base 11. Lastly, as shown in FIGS. 3E and 3F, the plating layer 18 which is made of a nickel plating layer and a tin plating layer is formed on the surface of the electrode 14.

In the above described manufacturing method for the circuit protective element, the impact-absorbing layer 12 is formed so as to cover both end portions of the insulating base 11. Thereafter, the conductive film 13 is formed so as to cover the surfaces of the base 11 and the impact-absorbing layer 12. Therefore, the impact-absorbing layer 12 can be formed between both end portions of the base 11 and the electrode 14. Consequently, even if a mechanical impact is applied on both end portions of the base 11 when the circuit protective element is held, this mechanical impact can be absorbed into the impact-absorbing layer 12. Therefore, in order to hold the circuit protective element, even if a chuck 100 is pressed, by a strong force, on the electrode 14 located on both end-portion sides of the base 11, then the corner portions at both end portions of the base 11 can be prevented from being chipped. This helps improve its yield rate.

In addition, the impact-absorbing layer 12 is formed before the conductive film 13 is formed. Therefore, when the impact-absorbing layer 12 is formed, the conductive film 13 which is an element assembly of an electronic component or the portion which fulfills the electrical function of the circuit protective element can be kept from being damaged. This prevents the characteristics of the circuit protective element from getting worse.

Furthermore, after the resist film 19 is formed on the whole surface other than both end portions of the base 11 which is made of an insulating mixture of ceramic and glass, the impact-absorbing layer 12 is formed so as to cover the entire surface of both end portions of the base 11. Thereafter, the resist film 19 is separated from the base 11. Therefore, the impact-absorbing layer 12 can be prevented from going out of the middle portion of the base 11, or the portion in which there is no need to provide the impact-absorbing layer 12. This makes it possible to form the impact-absorbing layer 12 precisely at the portion where it needs to be provided.

Herein, in the above described manufacturing method for the circuit protective element, the impact-absorbing layer 12 is formed only in both end portions of the insulating base 11 by an electro-less plating method. However, the impact-absorbing layer 12 may also be formed to cover on the whole surface of the resist film 19 by a sputtering method and the entire surface of both end portions of the base 11. In that case, if the resist film 19 is removed, the impact-absorbing layer 12 formed on the resist film 19 is also removed simultaneously. Therefore, in the same way as the case where the impact-absorbing layer 12 is selectively formed by means of electro-less plating, the impact-absorbing layer 12 can be formed only in both end portions of the insulating base 11.

INDUSTRIAL APPLICABILITY

As described so far, according to the present invention, an impact-absorbing layer is provided so as to cover at least the corner portions of both end portions of a base which is made of any of ceramic, glass, and a mixture of ceramic and glass, which have an insulation characteristic. In addition, a conductive film is formed so as to cover the surface of this impact-absorbing layer and the surface of the base. In this conductive film, the portion which covers the surface of the impact-absorbing layer is used as an electrode. Therefore, when a resistance value is measured, or when a resistance-adjusting groove is formed, in order to hold an electronic component, even if a chuck is pressed, by a strong force, against the electrode located on both end-portion sides of the base, then the impact-absorbing layer between both end portions of the base and the electrode formed on both end-portion sides of the base by a portion of the conductive film can absorb its mechanical impact. Thereby, the corner portions of both end portions of the base can be prevented from being chipped, thus improving its yield rate.

The invention claimed is:

1. An electronic component for performing an electrical function in a circuit, the electronic component comprising:

an insulating base;

an impact-absorbing layer formed so as to cover at least a corner portion of an end portion of the base and which absorbs a mechanical impact from a chuck applied to the end portion of the base to prevent the end portion of the base from chipping; and an electrically conductive film formed so as to be in direct contact with at least a portion of a surface of the base and a surface of the impact-absorbing layer and which performs the electrical function of the electronic component, wherein the electrically conductive film includes a first portion and a second portion, the first portion being in direct contact with the surface of the impact-absorbing layer, and being used as an electrode, the second portion being a resistance film and being formed in a separate portion of the electrically conductive film from the first portion and being in direct contact with the surface of the base, the first and second portions being formed so as to be continuous, such that the second portion extends substantially along an area between the first and second ends, and the impact-absorbing layer is disposed between the end portion of the base and the portion of the electrically conductive film being used as an electrode, wherein the impact-absorbing layer is made of a ductile metallic material, wherein the impact-absorbing layer is formed on both end surfaces of the base and on side surfaces which extend out from both end surfaces, and wherein when the resistance film is formed, the impact-absorbing layer absorbs the mechanical impact from the chuck applied to the electrode to prevent the end portion of the base from chipping.

2. The electronic component according to claim 1, wherein the base is made of one of ceramic, glass, and a mixture of ceramic and glass.

3. The electronic component according to claim 1, further comprising a resistance-adjusting groove which is formed in the second portion of the electrically conductive film.

4. The electronic component according to claim 3, wherein a narrow portion which is formed between tip portions of the resistance-adjusting groove is a fusing portion which serves as a fuse.

5. The electronic component according to claim 4, wherein the electronic component is a circuit protective element.

6. The electronic component according to claim 3, further comprising a protective film which is formed on the surface of the electrically conductive film so as to cover at least the resistance-adjusting groove.

7. The electronic component according to claim 3, wherein the resistance-adjusting groove is formed such that the electrically conductive film performs as a resistor as the electrical function of the electronic component.

8. The electronic component according to claim 3, wherein the resistance-adjusting groove is formed such that the electrically conductive film performs as an inductor as the electrical function of the electronic component.

9. The electronic component according to claim 3, wherein the resistance-adjusting groove is formed such that the electrically conductive film performs as a fuse as the electrical function of the electronic component.

10. The electronic component according to claim 3, wherein at least a portion of the resistance-adjusting groove is formed so as to be disposed approximately equidistant from the first and second ends.

11. The electronic component according to claim 1, further comprising a plating layer formed on the portions of the electrically conductive film that are located on both-end sides of the base.

12. An electronic-component manufacturing method, wherein the electronic component performs an electrical function in a circuit, the method comprising:

a first process of forming an impact-absorbing layer which absorbs a mechanical impact applied from a chuck to both end portions of an insulating base so as to cover at least a corner portion of an end portion of the insulating base so as to prevent the end portion of the insulating base from chipping;

after the first process, a second process of forming an electrically conductive film so as to be in direct contact with at least a portion of a surface of the base and a surface of the impact-absorbing layer, the electrically conductive film performing the electrical function of the electronic component; and chucking the substrate only after the impact-absorbing layer is formed to avoid chipping of the insulating base, wherein the electrically conductive film includes a first portion and a second portion, the first portion being in direct contact with the surface of the impact-absorbing layer, and being used as an electrode, the second portion being a resistance film and being formed in a separate portion of the electrically conductive film from the first portion and being in direct contact with the surface of the base, the first and second portions being formed so as to be continuous, such that the second portion extends substantially along an area between the first and second ends, and the impact-absorbing layer is disposed between the end portion of the base and the portion of the electrically conductive film being used as an electrode, wherein the impact-absorbing layer is made of a ductile metallic material, wherein the impact-absorbing layer is formed on both end surfaces of the base and on side surfaces which extend out from both end surfaces, and wherein when the resistance film is formed, the impact-absorbing layer absorbs the mechanical impact from the chuck applied to the electrode to prevent the end portion of the base from chipping.

13. The electronic-component manufacturing method according to claim 12, wherein the first process includes:

forming a resist film on the surface of the base except on the end portion of the base; and forming the impact-absorbing layer so as to cover a surface of the end portion of the base; and the second process includes:

removing the resist film from the surface of the base, and forming the electrically conductive film so as to be in direct contact with at least a portion of the surface of the base which is exposed after the resist film is removed, and the surface of the impact-absorbing layer.

14. The electronic-component manufacturing method according to claim 12, wherein the first process includes forming the impact-absorbing layer so as to cover at least the corner portion of the end portion of the base which is made of one of ceramic, glass, and a mixture of ceramic and glass.

15. The electronic-component manufacturing method according to claim 12, further comprising a third process of forming a resistance-adjusting groove in the second portion of the electrically conductive film.

16. The electronic-component manufacturing method according to claim 15, wherein the third process includes creating a fusing portion which serves as a fuse by forming a narrow portion between tip portions of the resistance-adjusting groove.

17. The electronic-component manufacturing method according to claim 15, further comprising a fourth process of forming a protective film on the surface of the electrically conductive film so as to cover at least the resistance-adjusting groove.

18. The electronic-component manufacturing method according to claim 17, further comprising a fifth process of forming a plating layer on portions of the electrically conductive film that are located on both-end sides of the base.

19. The electronic-component manufacturing method according to claim 15, wherein at least a portion of the resistance-adjusting groove is formed so as to be disposed approximately equidistant from the end portion of the base and another end portion of the base opposite the end portion of the base.

* * * * *